US005536437A

United States Patent [19]

Motyka

[11] Patent Number: 5,536,437

[45] Date of Patent: Jul. 16, 1996

[54] HARD SURFACE CLEANING COMPOSITION FORMED FROM A STRUCTURED SILICATE

[75] Inventor: Andrea Motyka, Doylestown, Pa.

[73] Assignee: Colgate-Palmolive Co., Piscataway, N.J.

[21] Appl. No.: 394,121

[22] Filed: Feb. 24, 1995

Related U.S. Application Data

[63] Continuation-in-part of Ser. No. 147,417, Nov. 5, 1993, abandoned, which is a continuation-in-part of Ser. No. 932,177, Aug. 19, 1992, abandoned.

[51] Int. Cl.[6] ..... C11D 1/83; C11D 3/08

[52] U.S. Cl. ..... 510/397; 510/369; 510/398; 510/418; 510/511

[58] Field of Search ..... 252/135, 174, 252/DIG. 14, 162, 170, 174.14

[56] References Cited

U.S. PATENT DOCUMENTS

| | | | |
|---|---|---|---|
| 4,537,604 | 8/1985 | Dawson | 51/298 |
| 4,758,377 | 7/1988 | Iding | 252/556 |
| 4,767,563 | 8/1988 | de Buzzaccarini | 252/174.25 |
| 4,788,005 | 11/1988 | Castro | 252/539 |
| 5,336,430 | 8/1994 | Bahary et al. | 252/174.17 |
| 5,393,455 | 2/1995 | Poethkow et al. | 252/174.25 |
| 5,427,707 | 6/1995 | Drapier et al. | 252/99 |

FOREIGN PATENT DOCUMENTS

| | | |
|---|---|---|
| 731221 | 3/1966 | Canada . |
| 1048365 | 2/1979 | Canada . |
| 239195 | 9/1987 | European Pat. Off. . |
| 7511342 | 6/1975 | Netherlands . |
| 7928 | 5/1992 | WIPO . |

*Primary Examiner*—Paul Lieberman
*Assistant Examiner*—Michael P. Tierney
*Attorney, Agent, or Firm*—Richard E. Nanfeldt; James Serafino

[57] ABSTRACT

Physically stable, non-scratching hard surface cleaning compositions having shear thickening properties are provided and include an alkali metal silicate, an inorganic or organic compound containing an alkali metal cation or an organic compound containing at least one hydroxyl group and water.

4 Claims, No Drawings

HARD SURFACE CLEANING COMPOSITION FORMED FROM A STRUCTURED SILICATE

RELATED APPLICATION

This application is a continuation in part application of U.S. Ser. No. 8/147,417 filed Nov. 5, 1993 now abandoned which in turn is a continuation in part application of U.S. Ser. No. 7/932,177 filed Aug. 19, 1992 now abandoned.

BACKGROUND OF THE INVENTION (1) Field of Invention

This invention relates to liquid, aqueous, stable, effective, safe, non-scratching hard surface cleaning compositions which have shear thickening properties and are commonly referred to as scouring cleansers. The compositions are physically stable, do not separate, whereby the user is assured of the optimum performance to be expected from the various components and their amounts and ratios with respect to one another. These compositions are also safe and do not scratch the usual surfaces to be cleaned, such as glass, porcelain, ceramic, plastic, metal, wood, painted wood (enameled and lacquered). The compositions of the instant invention because of their dilatant properties are especially useful in the cleaning of vertical surfaces.

(2) Prior Art Discussion

The art is replete with liquid scouring compositions alleged to perform in a safe and effective manner, while others are stated to be physically and chemically stable.

Some examples of prior art scouring compositions include U.S. Pat. No. 4,005,027 which describes compositions which include clay and insoluble abrasive. Only inorganic abrasives are shown and nonionics are not used. The compositions include surfactants which are bleach stable. It is alleged that the products are physically stable and also do not "appreciably run along vertical surfaces" (column 10, lines 45–47). Such stability is a manifestation of a false body fluid formed when using the smectite and attapulgite clays necessary in such compositions. The compositions of U.S. Pat. No. 4,116,849 are very similar to those in U.S. Pat. No. 4,005,027. In addition, U.S. Pat. No. 4,116,849 discloses thickening agents instead of the preferred smectite and attapulgite clays, such as collodial silica, polystyrenes, sulfonated polystyrenes, polyethylene, oxidized polyethylenes, polypropylene, copolymers of styrene with methacrylic acid, methyl or ethyl acrylate, vinyl acetate, among others; patentee states that "... ethoxylated nonionic surfactants are to be avoided." Neither of these two patents disclose soaps or fatty acids as suitable materials as well. U.S. Pat. No. 4,240,919 describes compositions of multivalent stearate soap, water and water-insoluble abrasive. Various abrasives are disclosed and among the "organic" types are "melamine, urea formaldehyde resins, ground rigid polymeric materials, such as polyeurethane foam ... " (column 3, lines 10–12). Optionally, there may be present "substantially any surfactant materials which are compatible with the other components in the composition of the present invention ... ". These include watersoluble anionic, nonionic, amphoteric, cationic and zwitterionic surfactants." (column 3, lines 57–62). Further reference is made to U.S. Pat. Nos. 4,051,056 (expanded perlite as abrasive), 4,457,856 (polyacrylate abrasive), German 1,956,616 (polyvinyl chloride as abrasive) and 3,645,904 (skin cleanser containing polymer abrasive material).

All of the compositions disclosed in the aforementioned prior art do not possess shear thickening properties. These compositions of the prior art are shear thinning at 25° C. as the rate of shear is increased. In other words, as the shear rate is increased as in the process of scrubbing, the viscosity of the composition will decrease. The compositions of the instant invention exhibit shear thickening properties at 25° C. which means that as the shear rate is increased the compositions will shear thicken. In a scrubbing process which causes an increase in the shear rate, the viscosity of the composition will increase and the composition will exhibit gel-like properties. This shear thickening of the compositions of the instant invention make them especially useful on vertical surface because of their tendency not to run off of the vertical surface which is being cleaned as compared to the prior art compositions.

U.S. Pat. No. 4,575,530 (Mar. 11, 1986) describes hydrocarbon solution additives which are polyampholytes which incorporates cationic and anionic moieties on the same polymeric backbone. These hydrocarbon solutions have shear thickening properties.

U.S. Pat. No. 4,536,539 (Aug. 20, 1985) claims include increasing the viscosity of water under increasing shear rates (22.0—approaching 100 $sec^{-1}$). This shear thickening behavior is primarily attributed to the increase in apparent molecular weight of the interpolymer complex through formation of intermolecular ionic linkages.

The instant invention teaches that these thickened silicates show shear thickening (dilatency) which means that the viscosity increases as shear rate at 25° C. is increased. Furthermore, the viscosity values at each shear rate are independent of the timescale of the experiment. Once the shear rate is applied, the viscosity reaches a steady value after a few seconds up to several minutes. Shear thickening occurs when the applied shear forces predominate the inter-particle forces. The shear forces change the dispersion from a certain degree of order to clusters of particles. Shear thickening behavior is dependent on particle shape, size and size distribution; particle volume fraction type and strength of inter-particle interaction; continuous phase viscosity; and the experimental parameters characterizing the shear thickening. These parameters include the type, rate, and duration of the applied shear deformation.

SUMMARY OF THE INVENTION

The present invention relates to liquid, aqueous, stable, effective, safe non-scratching hard surface cleaning compositions which have shear thickening properties at 25° C. and are commonly referred to as scouring cleansers. The compositions are physically stable, do not separate, whereby the user is assured of the optimum performance to be expected from the various components and their amounts and ratios with respect to one another. These compositions are also safe and do not scratch the usual surfaces to be cleaned, such as glass, porcelain, ceramic, plastic, metal, wood, painted wood (enameled and lacquered). The compositions of the instant invention because of their shear thickening properties at 25° C. are especially useful in the cleaning of vertical surfaces.

Accordingly, it is an object of the present invention to provide liquid, aqueous, stable, abrasive-containing cleaning composition which is shear thickening at 25° C. upon increasing shear rate.

It is another object of this invention to provide a liquid, aqueous abrasive-containing cleaning composition which is safe and also substantially non-scratching on most encountered surfaces, including plastic surfaces.

It is still another object of our invention to provide stable, liquid, aqueous polymer abrasive-containing cleaning compositions which are safe, effective and non-scratching.

It is a further object of the invention to provide a method for making the compositions of the invention.

Other objects will appear hereinafter as the description proceeds.

DESCRIPTION OF THE INVENTION

The objects of this invention are obtained in accordance with the following description wherein the liquid, shear thickening non-scratching, aqueous, scouring cleansing composition comprises an aqueous alkali metal silicate, an inorganic or organic compound containing an alkali metal cation or an organic compound containing at least one hydroxyl group and water and, optionally, a fatty acid and/or fatty acid soap, optionally, a surfactant, optionally at least one electrolyte and at least one particulate abrasive.

One preferred composition of the instant invention comprises approximately by weight:

(a) 20% to 50%, more preferably 30% to 45% of an alkali metal silicate selected from the group consisting of $Li_2O.x\ SiO_2$, $K_2O.ySiO_2$ and $Na_2O.z\ SiO_2$ and mixtures thereof, wherein x is equal to or greater than 2.1; y is equal to or greater than 2.1; and z is equal to or greater than 2.88;

(b) 0.5% to 40%, more preferably 5% to 30%, most preferably 15% to 30% of an inorganic or organic compound having an alkali metal cation, said alkali metal cation being selected from the group consisting of lithium, potassium, and sodium, said inorganic or organic compound being selected from the group consisting of alkali metal chlorides, alkali metal bromides, alkali metal sulfates, alkali metal hydroxides, alkali metal citrates, alkali metal salts of polyacetates, alkali metal salts of tartrates, alkali metal salts of maleates, alkali metal salts of alkenyl succinates, alkali metal salts of carboxymethyloxy succinates, alkali metal salts of nitrotriacitates, alkali metal carbonates, alkali metal bicarbonates, alkali metal sesquicarbonates, alkali metal orthophosphates, alkali metal pyrophosphates, alkali metal metaphosphates, alkali metal hexametaphosphates, alkali metal salts of $C_{10}$-$C_{20}$ alkyl sulfates; alkali metal salts of $C_{10-20}$ paraffin sulfonates, alkali metal salts of $C_{10}$-$C_{20}$ linear alkyl aryl sulfonates and alkali metal salts of $C_{10-20}$ ethoxylated alkyl ether sulfates;

(c) 0 to 10%, more preferably 1% to 7% of an abrasive; and (d) the balance being water, wherein the composition does not contain any borate anions or any crosslinked polyacrylic acid thickener such as Carbopol 941 manufactured by B. F. Goodrich Co. and the composition has a viscosity at 23° C. to 27° C. at a shear rate of 2 $sec^{-1}$ of about 4 to about 100 Pascal seconds and a viscosity at 23° C. to 27° C. at a shear rate of 10 $sec^{-1}$ of about 4 to about 120 Pascal seconds, wherein the viscosity of the composition at a shear rate of 10 $sec^{-1}$ is always greater than the viscosity of the composition at a shear rate of 2 $sec^{-1}$, wherein the alkali metal silicate exist in the composition as a viscoelastic network structure of the alkali metal silicate.

Another preferred composition of the instant invention comprises approximately by weight:

(a) 20% to 50%, more preferably 30% to 45% of an alkali metal silicate selected from the group consisting of $Li_2O.x\ SiO_2$, $K_2O.ySiO_2$ and $Na_2O.z\ SiO_2$ and mixtures thereof, wherein x is equal to or greater than 2.1; y is equal to or greater than 2.1; and z is equal to or greater than 2.88;

(b) 0.5% to 40% of an organic compound having the structure $$C_nH_{2n+2-x}(OH)_x$$

wherein x equals 1, 2 or 3 and n is about 1 to about 20, preferably about 1 to about 12;

(c) 0 to 10%, preferably 1% to 7% of an abrasive; and (d) the balance being water, wherein the composition does not contain any borate anions or any crosslinked polyacrylic acid thickener such as Carbopol 941 manufactured by B. F. Goodrich Co. and the composition has a viscosity at 23° C. to 27° C. at a shear rate of 2 $sec^{-1}$ of about 4 to about 60 Pascal seconds and a viscosity at 23° C. to 27° C. at a shear rate of 10 $sec^{-1}$ of about 6 to about 10 Pascal seconds, wherein the viscosity of the composition at 10 $sec^{-1}$ is always greater than the viscosity of the composition at a shear rate of 2 $sec^{-1}$, wherein the alkali metal silicate exist in the composition as a viscoelastic network structure of the alkali metal silicate.

Both of the preferred compositions of the exhibits increase in viscosity as the shear rate applied to the composition is increased and both compositions do not exhibit plastic flowable rheology.

The alkali metal silicate employed in the instant invention is selected from the group consisting of lithium silicate, potassium silicate and sodium silicate, wherein the alkali metal silicate has a concentration in the composition of at least about 20 wt. %, and preferably about 30 wt. % to about 50 wt. %. The alkali metal silicates are useful builder salts which function to make the composition dilatant. Sodium, lithium or potassium silicates having the formula $(M_2O)(xSiO_2)$ are used in the instant composition, wherein M is selected from the group consisting of lithium, potassium and sodium. When M is lithium or potassium, x is equal to or greater than 2.1 and when M is sodium, x is equal to or greater than 2.88. When sodium silicate is used, the value of x should preferably be greater than about 2.88, and the aqueous solution of the silicate should preferably be less than about 61% water or more than about 39% of the sodium silicate. If potassium silicate is used, the value of x should preferably be greater than about 2.1, and the aqueous content of a solution should preferably be less than about 66%. Lithium silicate ratio is preferably in the same range as the potassium silicate.

The alkali metal silicates used in the process of making the instant composition are in an aqueous solution comprising about 30 wt. % to about 60 wt. % of the alkali metal silicate and the balance being water. For example, a 39 wt. % aqueous solution of $(K_2O)2.1\ SiO_2$ was used in Examples 1–4. This means that 57 grams of the 39% aqueous solution the potassium silicate in Example 1–A was used to provide 22.5 wt. % of the potassium silicate in Example 1. The water from the aqueous solution of the potassium silicate is reflected as part of water as shown in Examples on the line indicating the wt. % of water.

The shear thickening characteristics of the instant compositions are formed by the incorporation into the aqueous composition a mixture of an alkali metal silicate and an inorganic or organic compound containing an alkali metal cation in the critical weight ratio of about 1:1 to 100:1, but preferably, 1:1 to 35:1, and even more preferably about 1:1 to about 20:1.

The electrolyte thickening molecules containing an alkali metal cation must be used in very concentrated (approaching saturation) aqueous solutions. Concentrations vary for each type of molecule used to thicken the silicate, since the solubility varies from molecule to molecule. For a given quantity of electrolyte solution thickening increases with the concentration of the solution.

One preferred composition must contain an inorganic or organic electrolyte compound having an alkali metal cation. Suitable inorganic compounds containing an alkali metal cation are sodium, potassium and lithium chlorides; sodium, potassium and lithium sulfates; and sodium, potassium and lithium nitrates. Suitable other alkali metal organic or inorganic compounds are alkali metal hydroxides, alkali metal salts of citrates, alkali metal salts of lower polycarboxylic acid salts, alkali metal salts of polyacetates, alkali metal salts of tartrates, alkali metal salts of maleates, alkali metal salts of alkenyl succinates, alkali metal salts of carboxymethyloxy succinates, alkali metal salts of nitrilotriacetates, alkali metal salts of polyacrylates, alkali metal salts of polymaleic anhydrides and alkali metal salts of copolymers of polyacrylates, polymaleic citrates anhydrides and polyacetal carboxylates. The alkali metal cation can comprise typical detergent builder salts. The detergent builder salts are selected from the group consisting of sodium, lithium and potassium carbonate; lithium, sodium and potassium bicarbonate; sodium, lithium and potassium sesquicarbonates; sodium, lithium and potassium orthophosphates, tripolyphosphates (hydrated or anhydrous), pyrophosphates, metaphosphates and hexametaphosphates; tetrasodium or tetrapotassium pyrophosphates; trisodium or tripotassium orthophosphate; and alkali metal phosphinates as illustrative of the inorganics; and ethylene diamine tetraacetic acid tetrasodium or potassium salt, trisodium or tripotassium nitrilotriacetate, sodium polymaleate, and the like as merely illustrative of the organics. A preferred solid builder salt is an alkali metal polyphosphate such as sodium tripolyphosphate ("NaTPP") or potassium tripolyphosphate ("KTPP"). Additionally, the organic compound could be an anionic surfactant containing an alkali metal cation as subsequently set forth herein.

In the other preferred composition, the organic compound, having at least one hydroxyl group which is employed in the instant compositions has the formula $$C_nH_{2n+2-x}(OH)x$$

wherein x=1, 2 or 3 and n is about 1 to about 20, preferably about 1 to 12. Typical examples of organic compounds having at least one hydroxyl group are selected from the group consisting of methanol, ethanol, n-propanol, isopropanol, n-butanol, isobutanol, propylene glycol, 1,6-hexanediol, sec-butanol, n-pentanol, isoheptanol, n-octanol, isooctanol, glycerol, butanediol, pentanediol, hexanetriol, hexadecanol and pentadecanol. The concentration of the organic or inorganic compound containing the alkali metal cation or the organic compound continuing at least one hydroxyl group in the composition is about 0.5 to about 40 weight percent, more preferably about 5 to about 30 weight percent. The weight ratio of the alkali metal silicate to the inorganic or organic compound containing the alkali metal cation is about 1000:1 to about 1:1, more preferably about 100:1 to about 1:1 and most preferably about 75:1 to about 1:1. The weight ratio of the alkali metal silicate to the organic compound containing at least one hydroxyl group is about 1000:1 to 1:1, more preferably about 500:1 to 1:1.

The fatty acid component which may be optionally used in the composition may be any fatty acid having a carbon chain of from about $C_6$-$C_{30}$ with $C_8$-$C_{20}$ being preferred. Most preferred are $C_{10}$-$C_{18}$ and typically, naturally occurring materials, such as coconut oil, palm oil, kernel oil, and animal tallow, serve admirably as sources for the fatty acids. A particularly preferred range of fatty acids is $C_{12}$-$C_{18}$ as one would find in coconut oil. A typical coconut oil fatty acid composition contains about 50% $C_{12}$; 20% $C_{14}$; 8.5% $C_{16}$; and 10% $C_{18}$ the balance being other acid and even perhaps some neutral material, and is a liquid at 40° C. While the most convenient sources are natural oils or fats yielded, mixed acids, of course, the individual specific acids, and indeed any mixture of any number and chain length of acids within the parameter of $C_6$-$C_{30}$ may be used. The fatty acid may comprise from about 0 to 15% by weight and preferably 0.5 to 10% and, more preferably 1 to 7% of the composition.

The non-soap anionic surfactant may be chosen from any of the conventional anionics, such as the alkyl benzene sulfonates, the alkyl sulfates, alcohol sulfates, the alcohol ether sulfates, olefin sulfonates, paraffin sulfonates, fatty acid monoglyceride sulfates, sarcosides, taurides and the like and their salts, such as alkali, alkaline, earth and ammonium salts. Of these, the sulfates and sulfonates are preferred.

The preferred non-soap anionic surfactants are the C 10-$C_{20}$ paraffin sulfonates; the $C_{10}$-$C_{20}$ linear alkyl benzene sulfonates, the $C_{10}$-$C_{20}$ alcohol sulfates and the C 10-$C_{20}$ alcohol ether sulfates.

The most preferred anionics (non-soap) are the $C_{12}$-$C_{18}$ paraffin sulfonates in the form of their alkali metal or ammonium salts; $C_8$-$C_{20}$ alkyl benzene sulfonates with $C_{12}$-$C_{16}$ being most highly preferred; the alkyl (i.e. alcohol) sulfates of $C_{12}$-$C_{18}$ and the corresponding ether sulfates with 3 to 50 (e.g. 3, 5, 10, 20, 30 and 50) moles of condensed ethylene oxide. The most preferred salt forming cation is sodium. The amount of the non-soap anionic may range from 0 to 15% by weight, preferably 1% to 10% and more preferably 1% to 5% by weight.

Some specific examples of suitable anionics are sodium lauryl sulfate, sodium paraffin ($C_{14}$-$C_{17}$) sulfonate, sodium decyl sulfate, sodium tridecyl sulfonate, sodium tallow alkyl sulfate, sodium coconut alkyl sulfate, sodium oxotridecyl-(triethoxyl) [sulfate (sulfated - 3 E.O. condensate with oxotridecyl alcohol], sodium dodecyl benzene sulfonate, sodium tridecyl benzene sulfonate, sodium tetradecyl benzene sulfonate and sodium ($C_{15}$) olefin sulfonate.

The nonionic surfactants which are usable herein are generally characterized by a long chain hydrophobe and a poly- (ethylene oxide) hydrophilic chain. The hydrophobe may and preferably is from an alcohol ($C_6$-$C_{30}$, preferably $C_8$-$C_{18}$; most preferably $C_{10}$-$C_{16}$, typically a $C_{13}$ alcohol, such as linear tridecyl alcohol), or a polypropylene backbone. Other hydrophobes, such as thioalcohols, acids, amines and the like, may also be used. The preferred alcohol is a $C_{10}$-$C_{16}$ alcohol with 1 to less than 5 moles of ethylene oxide and most preferably 2 to 4 moles of ethylene oxide, typically 3 moles of ethylene oxide. The level of nonionic in the formulation may vary from about 0 to about 15% by weight with preferred levels ranging from 0.1% to 10% by weight and most preferred from about 3.5% to 6.5% by weight typically and most highly preferred is 5% by weight.

The alkylpolysaccharides surfactants which are also useful alone or in conjunction with the aforementioned surfactants and have a hydrophobic group containing from about 8 to about 20 carbon atoms, preferably from about 10 to about 16 carbon atoms, most preferably from 12 to 14 carbons atoms, and polysaccharide hydrophilic group containing from about 1.5 to about 10, preferably from 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkylpolysaccharide surfactants.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, more preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkylpolysaccharides. When used in admixture with alkypolsaccharides, the alkylmonosaccharides are solubilized to some extent. The use of alkylmonosaccharides in admixture with alkylpolysaccharides is a preferred mode of carrying out the invention. Suitable mixtures include coconut alky, di-, tri-, tetra-, and pentaglucosides and tallow alkyl tetra-, penta-, and hexaglucosides.

The preferred alkylpolysaccharides are alkylpolyglucosides having the formula:

R20(CnH2nO)r(Z)x wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferably 0; and x is from 1.5 to about 8, preferably from 1.5 to 4, most preferably from 1.6 to 2.7. To prepare these compounds a long chain alcohol (R2OH) can be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside (x–2 to 4) to yield a short chain alkyl glucoside (x=1 to 4) which can in turn be reacted with a longer chain alcohol (R2OH) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkypolysaccharide surfactant is preferably less than about 2%, more preferably less than about 0.5% by weight of the total of the alkypolysaccharide. For some uses it is desirable to have the alkylmonosaccharide content less than about 10%.

The used herein, "alkylpolysaccharide surfactant" is intended to represent both the preferred glucose and galactose derived surfactants and the less preferred alkylpolysaccharide surfactants. Throughout this specification, "alkylpolyglucoside" is used to include alkylpolyglycosides because the stereo chemistry of the saccharide moiety is changed during the preparation reaction.

An especially preferred APG glycoside surfactant is APG 625 glycoside manufactured by the Henkel Corporation of Ambler, Pa. APG 625 is a nonionic alkypolyglycoside characterized by the formula:

$C_nH_{2n+1}O(C_6H10O5)xH$ wherein n=10(2%); n=12(65%); n=14(21–28%); n=16(4–8%) and n=18(0.5%) and x(degree of polymerization)=1.6. APG 625 has: a pH of 6–8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5–10 RPM of about 3,000 to about 7,000 cps. Mixtures of two or more of the liquid nonionic surfactants can be used and in some cases advantages can be obtained by the use of such mixtures.

The abrasive employed in the invention may be inorganic or polymeric. The inorganic abrasives are selected from the group consisting of quartz, pumice, samicite, titanium dioxide, aluminum oxide, silica sand, feldspar, silicon carbide and the like and mixtures thereof. The inorganic abrasives can be used along or in combination with polymeric abrasives. The inorganic abrasives which have a Mohr hardness of less than about 3, more preferably less than about 2.75 and are employed in the composition at about 0 weight percent to about 10 weight percent, more preferably about 1 to about 7.

The polymeric abrasive may be any material derived from a polymerizable composition, such as polyethylene, polypropylene, polystyrene, polyester, polyvinyl chloride, polyvinyl acetate, polymethyl methacrylate and various copolymers and interpolymers of the foregoing. The criteria for suitability are that the material does not scratch polymethyl methyacrylate and that the average particle size ranges from about 10 to 150 microns and preferably from 25 to 100 microns and most preferably from 30 to 75 microns, e.g. 60 microns. For optimum performance it is most desirable to utilize a polyvinyl chloride abrasive powder whose average particle size is about 60 microns, with a major amount being within the range of 30 to 75 microns. The molecular weight ranges of the polymeric abrasives may vary widely just so long as the physical properties set out above are met. Generally, molecular weights will range from several thousand (e.g. 2,000; 5,000; 20,000) to several hundred thousand (e.g. 125,000; 250,000; 400,000) and upwards of several million (e.g. 1,000,000; 2,000,000; 4,000,000; 6,000,000). The amount of abrasive may range from about 2% to 30% or more (e.g. 40%; 50%). A preferred range in the preferred formulations is from 5% to 25% and more preferred is a range of 5 to 15%, such as 7%; 10%; or 12%.

A large variety of optional ingredients may be included in the formulations of this invention. Optional additives include a hydrocarbon material, particularly a terpene, such as d-limonene. Such terpenes are readily available in many perfume materials which are generally added to most consumer cleaning products. The amount of the hydrocarbon may vary from 0.05 to 5% and preferably from 0.1 to 1 to 3%. Other additives which may be used include bleaches (liquid and solid hypochlorites, available, e.g. as NaOCl solution or calcium hypochlorite powder; chloramines, chlorinated di- and trisodium phosphates, sodium and potassium dichlorisocyanurate, trichlorocyanuric acid, and so forth); buffers, caustic soda; caustic potash; suds boosters; enzymes; preservatives; disinfectants; colorants; fragrances and the like, may be used where desired and compatible. Generally, minor amounts of such auxiliary materials are employed, at a concentration of 0.01% to 10% and often 0.1% to 5%.

The compositions of this invention are alkaline and generally have a pH from about 10 to 13. A typical, preferred pH is 11.5.

The compositions of this invention are prepared by adding to of an aqueous solution of an alkali metal silicate selected from the group consisting of lithium silicate, sodium silicate and potassium silicate, wherein the alkali metal silicate is in an aqueous solution at a concentration of about 30 wt. % to about 60 wt. % at a temperature of about 15° C. to about 30° C. with mixing an inorganic or organic having an alkali metal cation or an organic compound containing at least one hydroxyl group. The inorganic or organic compound containing an alkali metal compound can be any of the aforementioned electrolytes containing an alkali metal cation such as sodium tripolyphosphate, potassium tripolyphosphate, sodium or potassium phosphonate, potassium pyrophosphate and sodium citrate. Additionally, the organic compound could be an anionic surfactant containing an alkali metal cation as previously set forth herein. Other suitable inorganic compounds containing an alkali metal cation are sodium chloride, potassium chloride, lithium chloride, sodium sulfate, potassium sulfate, lithium sulfate, sodium nitrate, potassium nitrate and lithium nitrate.

The resultant composition of the alkali metal silicate, water and the inorganic compound containing the alkali metal cation exhibits shear thickening characteristics. The shear thickening composition has a viscosity at 23° C.–27° C. at a shear rate of 2 $sec^{-1}$ of about 4 to about 100 Pascal seconds and a viscosity at a shear rate of 10 $sec^{-1}$ of about 4 to about 120 Pascal seconds, wherein the viscosity at a shear rate of 10 $sec^{-1}$ of the composition is always greater than the viscosity at a shear rate of 2 $sec^{-1}$ of the composition.

The resultant composition of the alkali metal silicate, water and the organic compound containing at least one hydroxyl group exhibits shear thickening characteristics. The shear thickening composition has a viscosity at 23° C.–27° C. at a shear rate of 2 $sec^{-1}$ of about 4 to about 60 Pascal seconds and a viscosity at a shear rate of 10 $sec^{-1}$ of about 6 to about 100 Pascal seconds, wherein the viscosity at a shear rate of 10 $sec^{-1}$ of the composition is always greater than the viscosity at a shear rate of 2 $sec^{-1}$ of the composition.

The mechanism of thickening is such that the electrolyte or hydroxy containing organic compound condenses the alkali metal silicate by binding water to the electrolyte or hydroxy containing organic compound thereby promoting aggregation of the alkali metal silicate into a viscoelastic network type structure of the alkali metal silicate.

When the viscosity is plotted against the shear rate for the compositions at 25° C. of the instant invention a positive slope is obtained thereby indicating that the instant compositions are shear thickening. Upon the application of increasing shear rate to an aqueous solution of the composition the aqueous solution will shear thicken and an increase in viscosity will occur. The viscosity at a particular shear rate is independent of the time scale of the experiment. The compositions of the prior art exhibit a negative slop thereby showing these compositions are non shear thinning decrease in viscosity. To the dilatant composition of the aqueous alkali metal silicate, and the inorganic or organic compound containing an alkali metal cation or organic compound containing at least one hydroxyl group can be added various ingredients in any order, wherein the order of addition is not critical and the addition of these ingredients does not destroy the shear thickening property of the composition. The various ingredients are added at a temperature of about 15° C. to about 30° C., at a moderate shear rate of mixing. The various ingredients are the fatty acid component, and the non-soap anionic surfactant, the nonionic surfactant, abrasive and the aforementioned optional ingredients.

The following examples will serve to illustrate the present invention without being deemed limitative thereof. Parts and percents are by weight unless otherwise indicated.

EXAMPLE 1—Formulation of the Following Ingredients (wt. %) are Prepared:

| | A | B | C | D | E |
|---|---|---|---|---|---|
| Potassium Silicate[1] $K_2O(2.1\ SiO_2)$ | 22.5 | 9.7 | 26.7 | 28.8 | |
| Sodium Silicate $Na_2O(3.25\ SiO_2)$ | | 14.6 | | | 20.5 |
| Water | 57.7 | 64.9 | 61.6 | 62.0 | 55.6 |
| Sodium Polyacrylate | | 3.0 | 3.2 | | |
| Dowfax 3B2 | .1 | .5 | .4 | .5 | .4 |
| NaOH | .1 | | .2 | | .2 |
| Potassium Tripolyphosphate | 18.4 | | | | 17.7 |
| Sodium Tripolyphosphates | | | | | 4.4 |
| NaOCl | 1.2 | 1.3 | 1.3 | 1.4 | 1.2 |
| Potassium Carbonate | | 5.3 | 6.8 | 7.3 | |
| Sodium Carbonate | | .9 | | | |
| Shear thickening at 25° C. | yes | yes | yes | yes | yes |
| Shear thinning at 25° C. | no | no | no | no | no |

[1]This was used as 39 wt. % aqueous solution of $K_2O(2.1)\ SiO_2$. Therefore for example in Example 1 A 57 grams of the aqueous solution was used which yield 22.5 grams of the $K_2O(2.1)\ SiO_2$. This means that of the 57.7 grams of water in 1A that 34.5 grams came from the aqueous solution of the $K_2O(2.1)\ SiO_2$.

Viscosity was measured under the steady shear conditions on a Carri-Med CSL 100 rheometer, where radius=2 or 4 cm. and angle=4° at 25° C. Cone and plate geometrics were used. Viscosity was measured at a single shear rate value for 2 minutes. In all measurements, no time dependence of viscosity values was observed. Samples, after loading on the instrument, were covered with a low viscosity oil on their exposed edges in order to prevent drying out.

EXAMPLE 2—Formulation of the Following Ingredients (wt. %) are Prepared:

| | A | B | C | D | E | F | G |
|---|---|---|---|---|---|---|---|
| Potassium Silicate[2] $K_2O(2.1\ SiO_2)$ | 38.9% | 38.9% | 38.9% | 38.9% | 38.8% | 38.8% | 37.7% |
| Water | 60.3% | 60.3% | 60.3% | 60.3% | 60.2% | 60.2% | 58.5% |
| Methanol | .8% | | | | | | |
| 1-Propanol | | .8% | | | | | |
| 2-Propanol | | | .8% | | | | |
| 1-Heptanol | | | | .8% | | | |
| Propylene Glycol | | | | | 1.0% | | |
| 1.6 Hexanediol | | | | | | 1.0% | |
| Neodol 25-3S | | | | | | | 3.8% |
| Viscosity RT (pascal seconds) at shear rates of | | | | | | | |
| 2 $s^{-1}$ | 28 | 36 | 34 | 4.0 | 11.4 | 65 | 49.6 |
| 5 $s^{-1}$ | 30 | 37–38 | 35–36 | 4.1 | 12.2 | 70 | — |
| 7 $s^{-1}$ | 32 | 39 | 38 | 4.3 | 12.8 | 76 | 53.3 |
| 10 $s^{-1}$ | 34 | 42 | 41 | 4.9 | 13.5 | — | 62.2 |

[2]39 wt. % solution of potassium silicate.

To the solution of the aqueous potassium silicate is added with stirring at room temperature for 1–5 minutes the methanol, n-hexanol, 1-propanol, 2-propanol, 1 -hexanol, propylene glycol and 1,6 hexanediol.

EXAMPLE 3

The formulation of the following ingredients was prepared according to the procedure of Example 1, wherein the ingredients not sent forth in Example 1 are subsequently added to the mixed ingredients of Example 1 in the order as set forth in the following table.

| | (wt. %) |
|---|---|
| Potassium silicate | 35.9% |
| Water | 61.7% |
| Lithium Chloride | .9% |
| Dowfax 3B2 | .4% |
| Silica Sand | 1.1% |

The sample was measured for viscosity

| Shear rate 25° C. (Pascal seconds) | Viscosity (Pascal seconds) |
|---|---|
| 1 $s^{-1}$ | 4.6 |
| 2 $s^{-1}$ | 4.5 |
| 5 $s^{-1}$ | 4.4 |
| 7 $s^{-1}$ | 4.5 |
| 10 $s^{-1}$ | 4.6 |
| 12 $s^{-1}$ | 4.7 |
| 15 $s^{-1}$ | 4.8 |
| 17 $s^{-1}$ | 5.3 |
| 20 $s^{-1}$ | 5.5 |
| 25 $s^{-1}$ | 5.9 |
| 30 $s^{-1}$ | 6.6 |
| 35 $s^{-1}$ | 7.4 |
| 40 $s^{-1}$ | 8.8 |
| 45 $s^{-1}$ | 11.1 |

EXAMPLE 4

Formulations of the following ingredients (wt. %) were prepared according to the procedure of Example 1.

| | A | B | C |
|---|---|---|---|
| Potassium Silicate[3] $K_2O(2.1\ SiO_2)$ | 35.7 | 35.4 | 31.5 |
| Lithium chloride | 1.7 | | |
| Sodium citrate | | 5.3 | |

-continued

| | A | B | C |
|---|---|---|---|
| Sodium chloride | | | 13.3 |
| Water | 62.6 | 59.3 | 55.2 |
| Viscosity, 25° C. 2 $sec^{-1}$ (Pascal seconds) | 29.7 | 12.4 | 88.1 |
| Viscosity, 25° C. 10 $sec^{-1}$ (Pascal seconds) | 42.6 | 14.3 | 152.5 |

[3]39 wt. % solution of potassium silicate.

What is claimed is:

1. A shear thickening composition which consisting essentially of approximately by weight:

(a) 20% to 50% of an alkali metal silicate selected from the group consisting of $LiO_2(xSiO_2)$, $K_2O(ySiO_2)$ and $Na_2O(zSiO_2)$ and mixtures thereof, wherein x is equal to or greater than 2.1; y is equal to or greater than 2.1; and z is equal to or greater than 2.88;

(b) 0.5% to 40% of an inorganic salt or an organic salt selected from the group consisting of sodium hydroxide, sodium carbonate, sodium chloride, sodium tripolyphosphate, tetrasodium pyrophosphate, tetrapotassium pyrophosphate, alkali metal polyacetates, alkali metal tartrates, alkali metal citrates, alkali metal maleates, alkali metal alkenyl succinates and mixtures thereof (c) 1 to 7% of an abrasive;

(d) 1 to 10% anionic surfactant;

(e) 0.1 to 10% nonionic surfactant; and (f) the balance being water wherein the composition has a viscosity at 23° C. to 27° C. at a shear rate of 2 $sec^{-1}$ of about 4 to about 100 Pascal seconds and a viscosity at 23° C. to 27° C. at a shear rate of 10 $sec^{-1}$ of about 40 to about 120 Pascal seconds, wherein the viscosity of the composition at a shear rate of 10 $sec^{-1}$ is always greater than the viscosity of the composition at a shear rate of 2 $sec^{-1}$, wherein the alkali metal silicate exist in the composition as a viscoelastic network structure of the alkali metal silicate, wherein said composition does not contain any polyacrylic acid polymer, wherein the ratio of (a) to (b) ranges from 1:1 to about 20:1.

2. The composition of claim 1 wherein said abrasive is a polymeric or an inorganic abrasive.

3. The composition of claim 1, further including a terpene.

4. The composition of claim 1, further including a bleach.

* * * * *